US005697306A

United States Patent [19]

LaRue et al.

[11] Patent Number: 5,697,306

[45] Date of Patent: Dec. 16, 1997

[54] LOW $NO_x$ SHORT FLAME BURNER WITH CONTROL OF PRIMARY AIR/FUEL RATIO FOR $NO_x$ REDUCTION

[75] Inventors: Albert D. LaRue, Uniontown; Hamid Sarv, Canton, both of Ohio

[73] Assignee: The Babcock & Wilcox Company, New Orleans, La.

[21] Appl. No.: 789,049

[22] Filed: Jan. 28, 1997

[51] Int. Cl.[6] ..... F23C 1/12

[52] U.S. Cl. ..... 110/261; 431/183; 431/187; 431/189; 110/347

[58] Field of Search ..... 110/261, 262, 110/263, 264, 345, 346, 347; 431/182, 183, 184, 185, 186, 187

[56] References Cited

U.S. PATENT DOCUMENTS

| | | | |
|---|---|---|---|
| 710,033 | 9/1902 | Bailey | 110/104 B |
| 823,836 | 6/1906 | Wiemann | 431/186 |
| 1,870,013 | 8/1932 | Keenan, Jr. | 431/182 |
| 1,976,208 | 10/1934 | Agthe et al. | 239/404 |
| 2,267,025 | 12/1941 | Grindle | 431/174 |
| 3,049,085 | 8/1962 | Musat et al. | 431/183 |
| 3,074,361 | 1/1963 | Huge et al. | 431/185 |
| 3,111,271 | 11/1963 | Löfgren | 239/408 |
| 3,145,670 | 8/1964 | Copian et al. | 431/184 |
| 3,788,796 | 1/1974 | Krippene et al. | 431/2 |
| 3,904,349 | 9/1975 | Peterson et al. | 431/184 |
| 4,113,838 | 9/1978 | Koike et al. | 423/235 |
| 4,157,889 | 6/1979 | Bonnel | 431/182 |
| 4,206,712 | 6/1980 | Vatsky | 110/264 |
| 4,208,180 | 6/1980 | Nakayasu et al. | 431/284 |
| 4,270,895 | 6/1981 | Vatsky | 431/183 |
| 4,329,932 | 5/1982 | Takahashi et al. | 110/347 |
| 4,333,405 | 6/1982 | Michelfelder et al. | 110/264 |
| 4,380,202 | 4/1983 | LaRue et al. | 110/263 |
| 4,400,151 | 8/1983 | Vatsky | 431/184 |
| 4,412,810 | 11/1983 | Izuha et al. | 431/186 |
| 4,422,389 | 12/1983 | Schröder | 110/264 |
| 4,428,727 | 1/1984 | Deussner et al. | 431/182 |
| 4,479,442 | 10/1984 | Itse et al. | 110/261 |
| 4,545,307 | 10/1985 | Morita et al. | 110/264 |
| 4,627,366 | 12/1986 | LaRue et al. | 110/263 |

(List continued on next page.)

FOREIGN PATENT DOCUMENTS

| | | | |
|---|---|---|---|
| 2 307 399 | 2/1973 | Germany | 24/10 |
| 315-802-A1 | 10/1988 | Germany | F23D 1/02 |
| 303226 | 1/1929 | United Kingdom . | |

OTHER PUBLICATIONS

Jochem, M. et al. "Development of an Ultra Low $NO_x$ Staged Mixing Burner for Pulverized Coal", L.&C. Stienmüller GmbH, Germany, Technical Paper presented at the 1996 Joint Power Generation Conference. EC–vol. 4/FACT–vol. 21, 1996, pp. 119–149.

LaRue, A. D., et al. "Development Status of B&W's Second Generation Low $NO_x$ Burner—the XCL Burner", The Babcock & Wilcox Company, US, Technical Paper PGTP 87–12 presented to Joint Symposium on Stationary Combustion $NO_x$ Control, New Orleans, LA, Mar. 23–27, 1987. Entire paper.

*Primary Examiner*—Henry A. Bennett
*Assistant Examiner*—Pamela A. O'Connor
*Attorney, Agent, or Firm*—Robert J. Edwards; Eric Marich

[57] ABSTRACT

A burner for the combustion of a pulverized coal plus primary air mixture includes a nozzle pipe having an inlet for receiving a pulverized coal plus primary air mixture and an outlet for discharging same. A hollow plug extends axially within the nozzle pipe and defines an annular space between the plug and the nozzle pipe for conveying the pulverized coal plus primary air mixture therethrough. The hollow plug is axially moveable within the nozzle pipe. A variable amount of core air is supplied into the hollow plug so that it mixes with the primary air plus pulverized coal mixture at an outlet of the burner to vary the PA/PC ratio and maintain a desired primary air to primary coal ratio at the outlet of the burner. Natural gas can also be supplied into the hollow plug as a supplemental fuel for cofiring at the outlet end of the burner. The amount of core air supplied is based upon (1) the coal flow rate being provided to the burner, in lb/hr, and (2) the percent volatile matter content (%VM) in the coal being burned.

11 Claims, 5 Drawing Sheets

U.S. PATENT DOCUMENTS

| | | | |
|---|---|---|---|
| 4,654,001 | 3/1987 | LaRue | 431/354 |
| 4,669,398 | 6/1987 | Takahashi et al. | 110/347 |
| 4,748,919 | 6/1988 | Campobenedetto et al. | 110/264 |
| 4,768,948 | 9/1988 | Hansen et al. | 431/187 |
| 4,836,772 | 6/1989 | LaRue | 431/285 |
| 4,915,619 | 4/1990 | LaRue | 431/284 |
| 4,924,784 | 5/1990 | Lennon et al. | 110/261 |
| 5,003,891 | 4/1991 | Kaneko et al. | 110/341 |
| 5,027,723 | 7/1991 | Landreth et al. | 110/343 |
| 5,199,355 | 4/1993 | LaRue | 110/261 |
| 5,246,364 | 9/1993 | Landreth et al. | 431/3 |

LOW $NO_X$ SHORT FLAME BURNER WITH CONTROL OF PRIMARY AIR/FUEL RATIO FOR $NO_X$ REDUCTION

FIELD OF THE INVENTION

The present invention relates generally to fuel burners, and in particular, to a new and useful pulverized coal burner which achieves low $NO_x$ emissions by varying the ratio of primary air to pulverized coal while still producing a relatively short flame. To accomplish this variation, the present invention supplies an amount of core air into the burner determined as a function of the coal flow rate to the burner and the percent volatile matter content (%VM) in the coal being burned.

BACKGROUND OF THE INVENTION

Dual air zone coal burners are known which have various designs to produce low $NO_x$ as well as a short flame. To reduce flame length in some of these low $NO_x$ burners, impellers are installed at the exit of the coal nozzle. These serve to deflect the fuel jet, reducing axial fuel momentum and reducing flame length. However, $NO_x$ increases significantly with such impellers and a tradeoff between reduced flame length and increased $NO_x$ is always required.

U.S. Pat. No. 4,400,151 to Vatsky discloses a burner which separates the fuel jet into several streams which are accelerated and deflected at the nozzle exit. This design also provides for some fuel jet velocity control with some effectiveness, and improved $NO_x$ performance.

Tests have shown that the burner of U.S. Pat. No. 4,836,772 to LaRue can also produce a short flame with very low $NO_x$. However, very high secondary air swirl is required to counteract the fuel jet momentum. The high secondary air swirl requires a prohibitively high burner pressure drop.

U.S. Pat. No. 5,199,355 to LaRue discloses a burner which can simultaneously achieve low $NO_x$ emissions with a relatively short flame. This burner generally resembles the burner disclosed in U.S. Pat. No. 4,836,772 with an axial coal nozzle and dual air zones surrounding the nozzle. However, the coal nozzle is altered to accommodate a hollow plug. A pipe extends from the burner elbow through the nozzle pipe, which uses a conical diffuser. The coal/primary air (PA) mixture is dispersed by the conical diffuser into a pattern more fuel rich near the walls of the nozzle and fuel lean toward the center as in U.S. Pat. No. 4,380,202 to LaRue. The nozzle then expands to about twice the flow area compared to the inlet. As the nozzle expands, the hollow plug is expanded to occupy an area roughly equivalent to the inlet area of the nozzle. Therefore the fuel/PA mixture traveling along the outside of the hollow plug is at about the same velocity as at the entrance of the nozzle. The center pipe with the hollow plug can be moved fore/aft relative to the end of the burner nozzle and thereby change the fuel/PA exit velocity from the nozzle. This design enables a fuel rich flame core to form immediately downstream of the burner nozzle, which is essential to control $NO_x$ emissions. In addition, the momentum of the fuel jet is reduced to reduce flame length. Reduced flame length avoids flame impingement on furnace walls, and associated problems with unburned carbon, slag deposition, and tube corrosion. The ability to vary burner nozzle exit velocity is also beneficial for improving flame stability for difficult to burn pulverized fuels, such as low grade lignites or delayed petroleum coke. The pipe and plug of U.S. Pat. No. 5,199,355 can also be ducted at diverging portions thereof to provide small quantities of air or recirculated gas into the annular nozzle space to further reduce $NO_x$ or to control flame shape.

The problem with all of the above-described low $NO_x$ pulverized coal-fired burners is the lack of adjustment of the primary air/pulverized coal (PA/PC) ratio. For a given coal type, the relative amount of primary air to pulverized coal sets the stoichiometry in the fuel rich core of the burner. This is a critical parameter which affects ignition and the rate of combustion. The quantity of volatile matter and its release rate are dependent on inherent coal properties and also on the amount of coal particle heating. The quantity and release rate of volatile matter are critical to the formation and control of $NO_x$ emissions from pulverized coal. $NO_x$ is most readily controlled by fuel nitrogen which is released with the volatiles, in a fuel rich environment. At too low a PA/PC ratio, insufficient air is available to burn much of the volatile matter. This reduces temperature in the flame core. The quantity of volatile matter released by a coal particle is a function of the temperature the particle reaches. Higher temperatures result in higher volatile matter production. Therefore, too low a PA/PC ratio retards the rate of combustion in the flame core, pushing combustion downstream in the flame where the flame core diffuses into a more air-rich environment, causing increased $NO_x$ formation. On the other hand, too high of a PA/PC ratio permits $NH_i$ (where i=1, 2, 3) and CN species (released with the volatile matter) to oxidize to NO. In addition, an excessively high PA/PC ratio also has a moderating effect on temperature and flame stabilization. In conclusion, for a given type of coal, there is an optimum PA/PC ratio for control of $NO_x$ emissions, which depends on coal characteristics and the burner design.

Unfortunately, the PA/PC ratio is not a variable controllable by conventional burners; the PA/PC ratio is generally a consequence of the pulverizer design and primary air transport criteria for transporting pulverized coal in the pipes in between the pulverizers and the burners. PA/PC ratios typically vary from about 1.0 to 2.0 lb air/lb coal for different types of pulverizers at their maximum design grinding capacity. As coal input is reduced from the pulverizer design maximum, the PA/PC ratio usually increases for a given mill, because the primary air flow may not decrease in the same proportion. Accordingly, a burner is needed which would compensate for these variations; i.e., a burner where the PA/PC ratio is a controlled variable for minimizing $NO_x$ from the burner.

SUMMARY OF THE INVENTION

The present invention solves the mentioned problems associated with prior art pulverized coal fired burners as well as other problems by providing a burner having means for varying the PA/PC ratio in the burner nozzle to reduce $NO_x$ emissions beyond levels otherwise achieved in pulverized coal burners. The present burner is able to accomplish this with a short flame which facilitates its use while avoiding flame impingement. The burner is based on the burner configuration of U.S. Pat. No. 5,199,355, which accounts for its short flame characteristics. $NO_x$ reduction is enhanced by the addition of a quantity of core air to the PA/PC mixture to optimize this ratio for the type of coal being fired and the coal flow rate to the burner. The quantity of core air provided, in lb/hr, is based upon (1) the coal flow rate being provided to the burner, in lb/hr, and (2) the percent volatile matter content (%VM) in the coal being burned. The optimum core air flow rate, in lb/hr, is thus given by the following relationship: Optimum core air flow rate (lb/hr)= 1.2×coal flow rate (lb/hr)×(%VM/100).

A necessary consequence of this relationship is that, for a given coal flow rate, more core air flow is necessary as the percent volatile matter content in the coal increases. The percent volatile matter content in the coal is determined from conventional coal Proximate Analysis procedures, such as those available in American Society for Testing and Materials (ASTM) standard D3172.

Test results have also shown that low $NO_x$ emissions can also be achieved when operating with an amount of core air flow within approximately plus/minus 25% of the optimum core air flow rate defined above. That is, low $NO_x$ emissions can be achieved when operating with core air flow rates within approximately the following upper and lower core air flow rates: Upper core air flow rate (lb/hr)=1.5×coal flow rate (lb/hr)×(%VM/100); and Lower core air flow rate (lb/hr)=0.9×coal flow rate (lb/hr)×(%VM/100).

To allow for the introduction of these amounts of core air flow, the plug of the burner disclosed in U.S. Pat. No. 5,199,355 is replaced with an open-ended hollow plug. The hollow plug provides a means to introduce the core air near the outlet end of the burner nozzle pipe to maintain an optimal PA/PC ratio. As necessary, secondary air flow rate is adjusted to maintain a constant overall stoichiometry as a function of load.

In certain cases, internal mixing devices within the hollow plug, such as a perforated plate, may be employed to more evenly distribute the core air flow at the outlet of the hollow plug. In other cases, mixing devices such as a swirler are used to advantage at the open outlet end of the hollow plug to accelerate mixing of the additional air with the normally supplied PA/PC mixture. Reducing the length of the hollow plug, or retracting it from the end of the burner nozzle, under certain circumstances, provides more complete mixing of the added air with the PA/PC mixture. Using a 45° swirler at the outlet end of the hollow plug rapidly directs the core air out into the surrounding PA/PC mixture. This raises the stoichiometry as intended while leaving the area in front of the plug free of axial flow, which promotes recirculation back into this area providing reduced flame lengths.

In view of the foregoing it will be seen that one aspect of the present invention is drawn to a hollow plug pulverized coal burner capable of reduced $NO_x$ emissions below those achievable with prior art low $NO_x$ pulverized coal fired burners, by the addition of a controlled amount of core air to the burner, in combination with appropriate mixing devices.

Another aspect of the present invention is drawn to a pulverized coal burner having a short flame in combination with very low $NO_x$ emissions having a flame length comparable to burners without $NO_x$ control, and which can compensate for non-optimal PA/PC ratios at the burner outlet obtained by fuel transport requirements from the pulverizer, to achieve very low $NO_x$ emissions. In some situations, supplemental fuel such as natural gas can be introduced into a conduit extending along the hollow plug to permit it to be cofired at the outlet end of the burner with the PA/PC mixture to further reduce $NO_x$ emissions and unburned combustibles. In other cases, very high PA/PC ratios may already be present, and which exceed optimum values. In these cases, flue gas could be introduced into the hollow plug to reduce the partial pressure of oxidant to fuel.

The various features of novelty which characterize the invention are pointed out with particularity in the claims annexed to and forming a pan of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
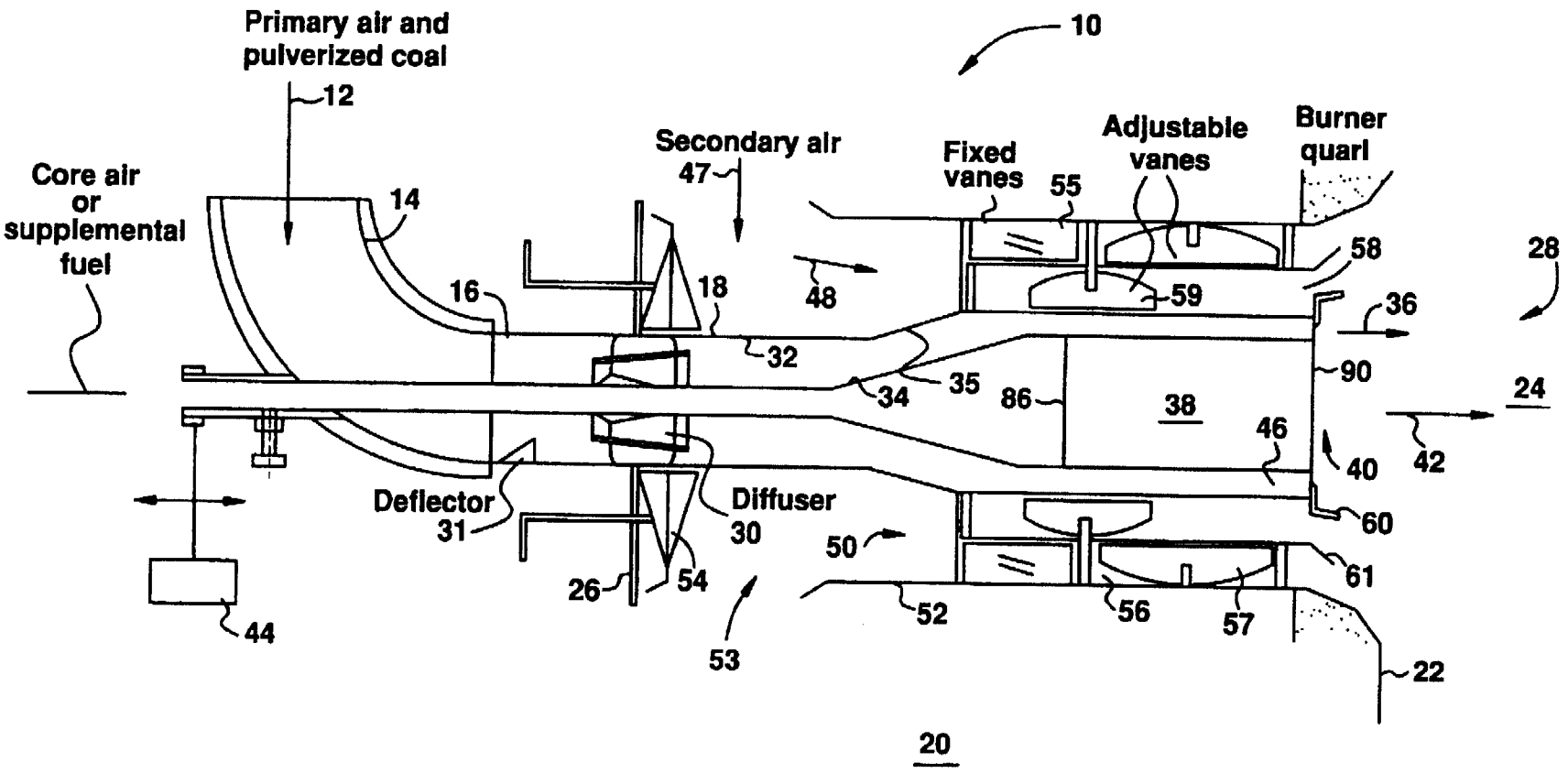
FIG. 1 is a schematic sectional view of a first embodiment of a pulverized coal burner constructed in accordance with the present invention.

Referring to the drawings generally, wherein like numerals designate the same or functionally similar elements throughout the several drawings, and to FIG. 1 in particular, the invention embodied therein comprises a burner generally designated 10 which is particularly designed for burning a primary air plus pulverized coal (PA/PC) mixture 12 supplied (typically) via an elbow member 14 to a coal pipe nozzle inlet 16. The nozzle inlet 16 supplies the PA/PC mixture 12 to the inlet of a central nozzle pipe 18 which extends across a secondary air windbox 20 defined between a water wall 22 which acts as a boundary for a combustion chamber 24, and an outer windbox wall 26. Water tubes (not shown) forming water wall 22 are bent to form a conical burner port 28 having a diverging wall extending into the combustion chamber 24. A conical diffuser 30 and deflector 31 are positioned in the central nozzle pipe 18 for dispersing the PA/PC mixture 12 into a pattern which is more fuel rich near an inner surface or wall 32 of the nozzle pipe 18, and more fuel lean towards the outer wall 34 of a hollow plug 38 positioned within the central nozzle pipe 18. Hollow plug 38 may contain various structures including, for example, conduits for ignition means and for oil atomizers and has an atomizer outlet 40 for discharging an atomized oil plus medium mixture 42 into the combustion chamber 24. The atomizing medium may be steam or air for example.

Drive means shown schematically at 44 are connected to the plug 38 for moving the plug axially in the fore and aft direction of the double arrow. This causes the outwardly diverging outer walls 34 of hollow plug 38 to move closer to or further away from the outwardly diverging walls 35 of central nozzle pipe 18, to change the velocity of the PA/PC mixture 12 exiting through an annular outlet opening 46 defined between the central nozzle pipe 18 and the hollow plug 38, and into the combustion chamber 24. The exiting PA/PC mixture is schematically represented by and flows in the direction of arrows 36.

Secondary air 47 flows from windbox 20 in the direction of arrows 48 into an annular secondary air passage 50 defined between an outer surface of central nozzle pipe 18 and an inner surface of a burner barrel 52. An annular inlet 53 into annular secondary air passage 50 can be opened or closed by axially moving a slide damper 54 which is slidably mounted on the outer surface of central nozzle pipe 18.

Annular secondary air passage 50, near combustion chamber 24, is divided into an outer annular passage 56 containing one or more fixed vanes 55 and one or more adjustable swirling vanes 57, and an inner annular passage 58 containing one or more adjustable swirling vanes 59. Secondary air is thus discharged in an annular pattern around the exiting PA/PC mixture 36, past an air separation vane 61, through the burner port 28 and into the combustion chamber 24. A perforated plate 86 may be employed in hollow plug 38, as discussed later, to produce an even distribution of core air at an outlet end 90 of the hollow plug 38.

With the plug positioned as shown, the exiting PA/PC mixture 36 leaves the central nozzle pipe 18 with a velocity similar to that of the burner described in U.S. Pat. No. 4,836,772 and may pass through a flame stabilizing ring 60 to stabilize and accelerate combustion. However, as the PA/PC mixture 36 leaves the central nozzle pipe 18 the bluff body effect of the hollow plug 38 makes the adjacent flow streams pull in/recirculate to occupy this zone, which effectively reduces the axial momentum of the PA/PC mixture 36 jet. This zone remains fuel rich to achieve low $NO_x$ emissions. The reduced fuel jet momentum tends to reduce flame length for two reasons. One, the coal particles have more time to burn out per unit distance from the burner 10. Two, the reduced fuel jet momentum enables the surrounding swirling secondary air 47 (with combustion by-products) to more readily penetrate and complete mixing with the fuel jet at a moderate distance from the burner 10.

The geometry of this arrangement enables operation, as disclosed in U.S. Pat. No. 5,199,355, in such a way as to vary the burner central nozzle pipe 18 exit velocity by repositioning of the hollow plug 38 fore/aft relative to the end of the nozzle pipe 18, consequently affecting $NO_x$ formation and flame length. Lower exit velocities can be achieved by partially retracting the hollow plug 38, shortening the flame. Thus the optimum flame length is easily provided by this movement. The $NO_x$ minimization is then adjusted by varying the primary air/pulverized coal (PA/PC) ratio as per the present invention.

For a given coal type, the relative amount of primary air to pulverized coal sets the stoichiometry in the fuel rich core of the burner. This is a critical parameter which affects ignition and the rate of combustion. The quantity of volatile matter and its release rate are dependent on the amount of coal particle heating. The quantity and release rate of volatile matter are critical to the formation and control of $NO_x$ emissions from pulverized coal. $NO_x$ is most readily controlled by fuel nitrogen which is released with the volatiles, in a fuel rich environment. At too low PA/PC ratios, insufficient air is available to burn much of the volatile matter. This reduces temperature in the flame core produced by the burner (not shown). The quantity of volatile matter released by a coal particle is a function of the temperature the particle reaches. Higher temperatures result in higher volatile matter production. Therefore too low PA/PC ratios retard the rate of combustion in the flame core, pushing combustion downstream in the flame where the flame core diffuses into a more air-rich environment, causing increased $NO_x$ formation. On the other hand, too high of a PA/PC ratio permits NH, and CN species (released with the volatile matter) to oxidize to NO. In addition, an excessively high PA/PC ratio also has a moderating effect on temperature and flame stabilization. In conclusion, for a given coal, there is an optimum PA/PC ratio for control of $NO_x$ emissions, which depends on coal characteristics and the burner design.

The PA/PC ratio is thus a variable controllable by the present invention. Unless otherwise controlled the PA/PC ratio is, for the most part, a consequence of the pulverizer design and transport requirements in the coal pipes. PA/PC ratios typically vary from about 1.0 to 2.0 lb-air/lb-coal for different types of pulverizers at maximum design grinding capacity. As coal input is reduced from the pulverizer design maximum, the PA/PC ratio usually increases for a given mill, because the primary air flow may not decrease in the same, proportion. The burner 10 as shown in the Figs. can vary the PA/PC ratio at the outlet of the burner nozzle pipe 18, to reduce $NO_x$ emissions beyond levels otherwise achieved. The burner 10 is able to accomplish this with a short flame which avoids flame impingement by varying the retraction of the hollow plug 38 to optimize flame length.

$NO_x$ reduction is enhanced by the addition of a quantity of core air to the PA/PC mixture to optimize this ratio for the type of coal being fired and the coal flow rate to the burner. The quantity of core air provided, in lb/hr, is based upon (1) the coal flow rate being provided to the burner, in lb/hr, and (2) the percent volatile matter content (%VM) in the coal being burned. Test results have determined that the optimum core air flow rate, in lb/hr, is approximately given by the following relationship: Optimum core air flow rate (lb/hr)= 1.2×coal flow rate (lb/hr)×(% VM/100).

A necessary consequence of this relationship is that, for a given coal flow rate, more core air flow is necessary as the percent volatile matter content in the coal increases. The percent volatile matter content in the coal is determined from conventional coal Proximate Analysis procedures, such as those available in American Society for Testing and Materials (ASTM) standard D3172.

Test results have also shown that low $NO_x$ emissions can also be achieved when operating with an amount of core air flow within approximately plus/minus 25% of the optimum core air flow rate defined above. That is, low $NO_x$ emissions can be achieved when operating with core air flow rates within approximately the following upper and lower core air flow rates: Upper core air flow rate (lb/hr)=1.5×coal flow rate (lb/hr)×(%VM/100); and Lower core air flow rate (lb/hr)=0.9×coal flow rate (lb/hr)×(%VM/100).

To allow for the introduction of these amounts of core air flow, the plug of the burner disclosed in U.S. Pat. No. 5,199,355 is replaced with the open-ended hollow plug 38. The hollow plug 38 provides a means to introduce the core air near the outlet end of the burner nozzle pipe 18 to maintain an optimal PA/PC ratio. As necessary, secondary air flow rate is adjusted to maintain a constant overall stoichiometry as a function of load.

Figure 2:
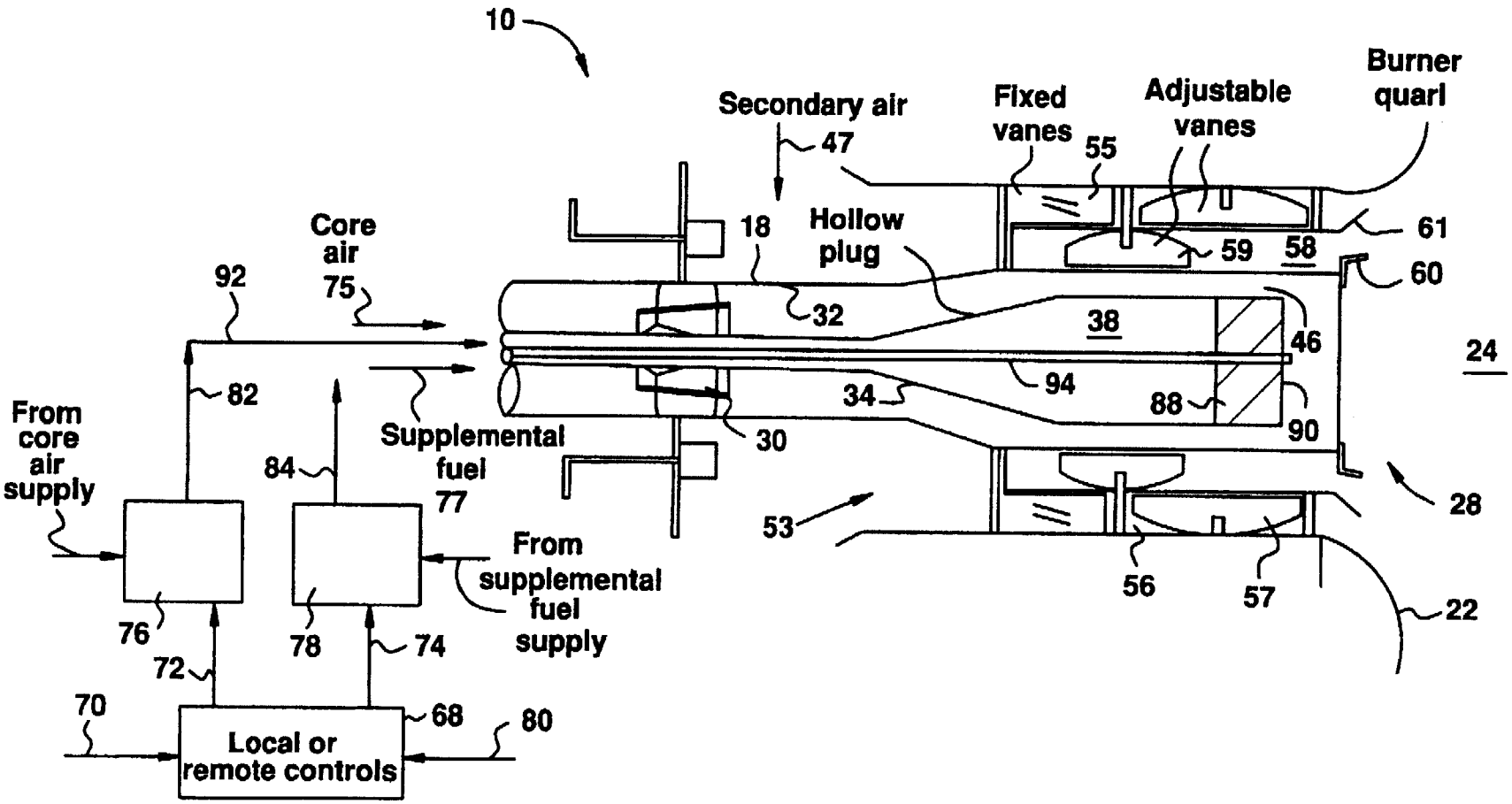
FIG. 2 is a schematic sectional view of a second embodiment of a pulverized coal burner according to the present invention, along with a simplified schematic representation of a control system which could be used for maintaining an optimal PA/PC ratio according to the present invention, wherein the burner is provided with a 45° swirler at the outlet of the hollow plug.
Figure 6:
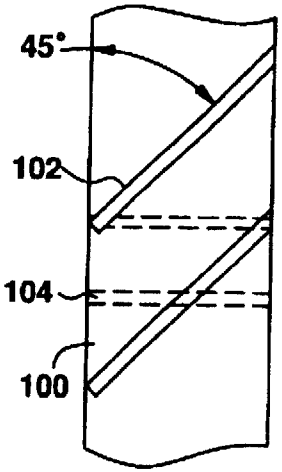
FIG. 6 is a partial sectional view of the 45° swirler of FIG. 5.
Figure 5:
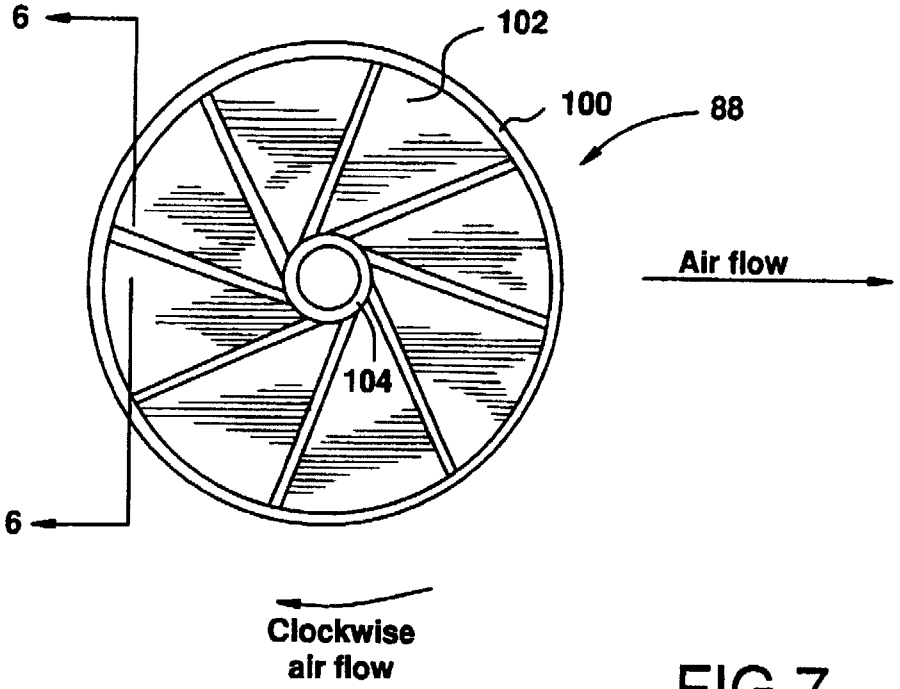
FIG. 5 is an end view of a 45° swirler used in the present invention.
Figure 7:
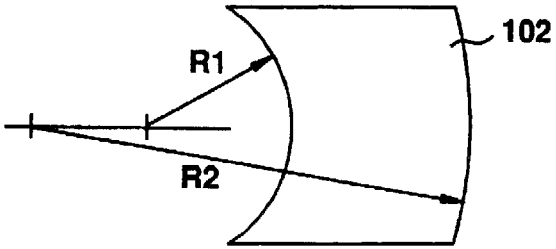
FIG. 7 is a view of an individual blade used in the 45° swirler of FIGS. 5 and 6.

Referring now to FIG. 2, there is shown a schematic sectional view of a second embodiment of a pulverized coal burner 10 according to the present invention, along with a simplified schematic representation of a control system which could be used for maintaining an optimal PA/PC ratio according to the present invention. As illustrated therein, the burner 10 is provided with a 45° swirler 88 at the outlet 90 of the hollow plug 38. Constructional details of the 45° swirler 88 are shown in FIGS. 5–7, discussed infra. The hollow plug 38 can also be retracted to tailor flame shape; testing showed 3" to be sufficient but actual field installation conditions would set the actual amount of retraction. To control the introduction of the core air into the hollow plug 38, local or remote control unit means 68, advantageously microprocessor based, could be provided with a control signal, schematically indicated at 70 from a human operator. Alternatively, the control signal 70 could be automatically produced by the utility plant control system in a manner known to those skilled in the art. The control unit 68 would then provide a suitable introduction of along lines 72 to means for controlling the introduction of the core air, schematically represented at 76, from a core air supply. Advantageously, the core air supply could be the same source which supplies the secondary air to the burner 10. The control means 76 could advantageously comprise any one of known valves, dampers or the like. From control means 76, the core air (designated 75) would be provided along conduits 82 and 92 and thence into the hollow plug 38. Cofiring natural gas can further reduce $NO_x$ emissions and reduce unburned combustibles. Accordingly, analogous control signals could be provided by the control unit 68 via line 74 to a supplemental fuel supply controller unit designated 78 which would control the introduction of supplemental fuel 77, advantageously natural gas, into the hollow plug 38. In such a case, the natural gas 77 would not mix until it reaches the outlet end of the hollow plug 38. A conduit 84 would be provided and connected to a tube 94 extending along the axis of the burner 10 as shown, and would also extend through the 45° swirler 88 as shown. It is understood that the local or remote control unit means 68 could be automatically controlled and provided with a set point signal schematically indicated at 80 to maintain a desired range of core air 75 or supplemental fuel 77 provided into the hollow plug 38 as necessary to produce desired PA/PC ratios and minimize $NO_x$ emissions and unburned combustibles.

In most cases, this optimization is reached using only this added core air; an amount of added core air equal to approximately 4% of the total combustion air has been shown to be sufficient for this purpose, and when the total combustion air provided to the burner is set at 16% excess air. As shown in FIG. 1, the added air supplied to the plug 38 may be diffused through a perforated plate 86 to produce an even or homogeneous mixture exiting the plug 38. In contrast, as shown in FIG. 2 (and FIGS. 3 and 4, infra) if a swirler 88 is employed at an outlet 90 of the hollow plug 38, the perforated plate 86 would generally not be employed.

Appropriate mixing devices can be used to advantage at the open end of the hollow plug 38 to accelerate mixing of the secondary air with the PA/PC mixture 36 exiting the plug 38. The end of the hollow plug 38 is either shortened or retracted from the end of the burner nozzle pipe 18. This configuration provides more complete mixing of the secondary air with the PA/PC mixture 36. The use of mixing devices near the end of the burner nozzle have demonstrated further reductions in $NO_x$ emissions, during combustion tests. More specifically, the use of a 45° swirler 88 at the exit 90 of the hollow plug 38 rapidly directs the nozzle air out into the PA/PC mixture 36. This raises the stoichiometry as required, while leaving the area in front of the plug 38 substantially free of axial flow. This promotes recirculation back into this area resulting in reduced flame length.

By increasing or decreasing air to the hollow plug 38, the present invention provides a means for varying the velocity at the exit of the coal nozzle, without moving the plug 38 fore/aft. Low volatile coals need little or no air to burn the volatiles, and this lowers the exit velocity and thus improves flame stability for these difficult to ignite coals. Raising the temperature of the air to the hollow plug 38 by preheating the added air serves to preheat the PA/PC mixture which also improves ignition.

Figure 3:
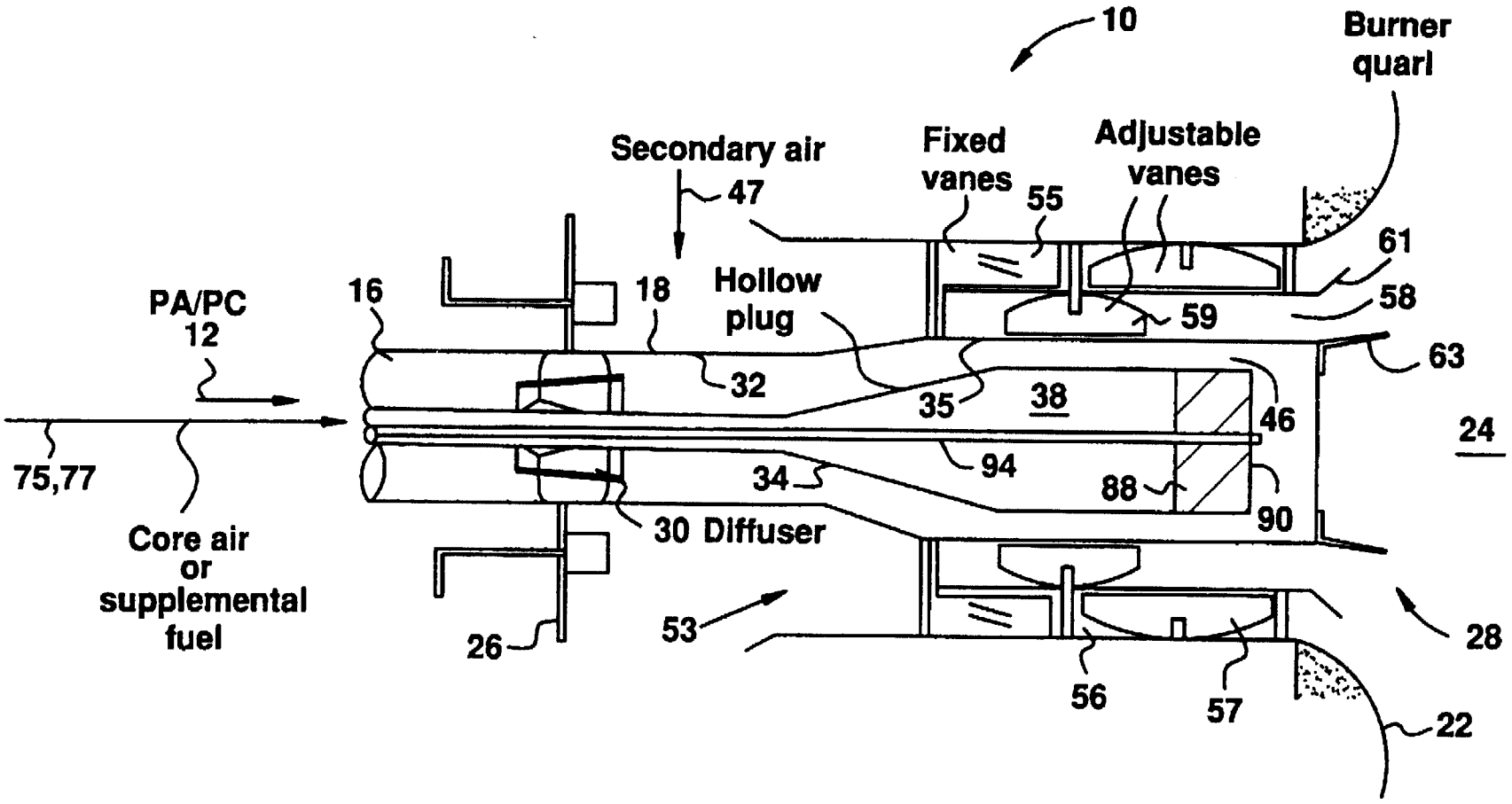
FIG. 3 is a schematic sectional view of a third embodiment of a pulverized coal burner according to the present invention, also using a 45° swirler at the outlet of the hollow plug, and which employs an extended flame stabilizing ring.

Referring now to FIG. 3, there is shown a schematic sectional view of a third embodiment of a pulverized coal burner 10 according to the present invention, also using a 45° swirler 88 at the outlet 90 of the hollow plug 38, and which employs an extended flame stabilizing ring 63 which is longer than those employed in the earlier embodiments. In this embodiment, the back end of the flame stabilizing ring 63 connects directly to the horizontal section 35 at the outlet of the nozzle pipe 18 and does not have any appreciable portion extending into or obstructing secondary air flow through the annular secondary air passage 58.

Figure 4:
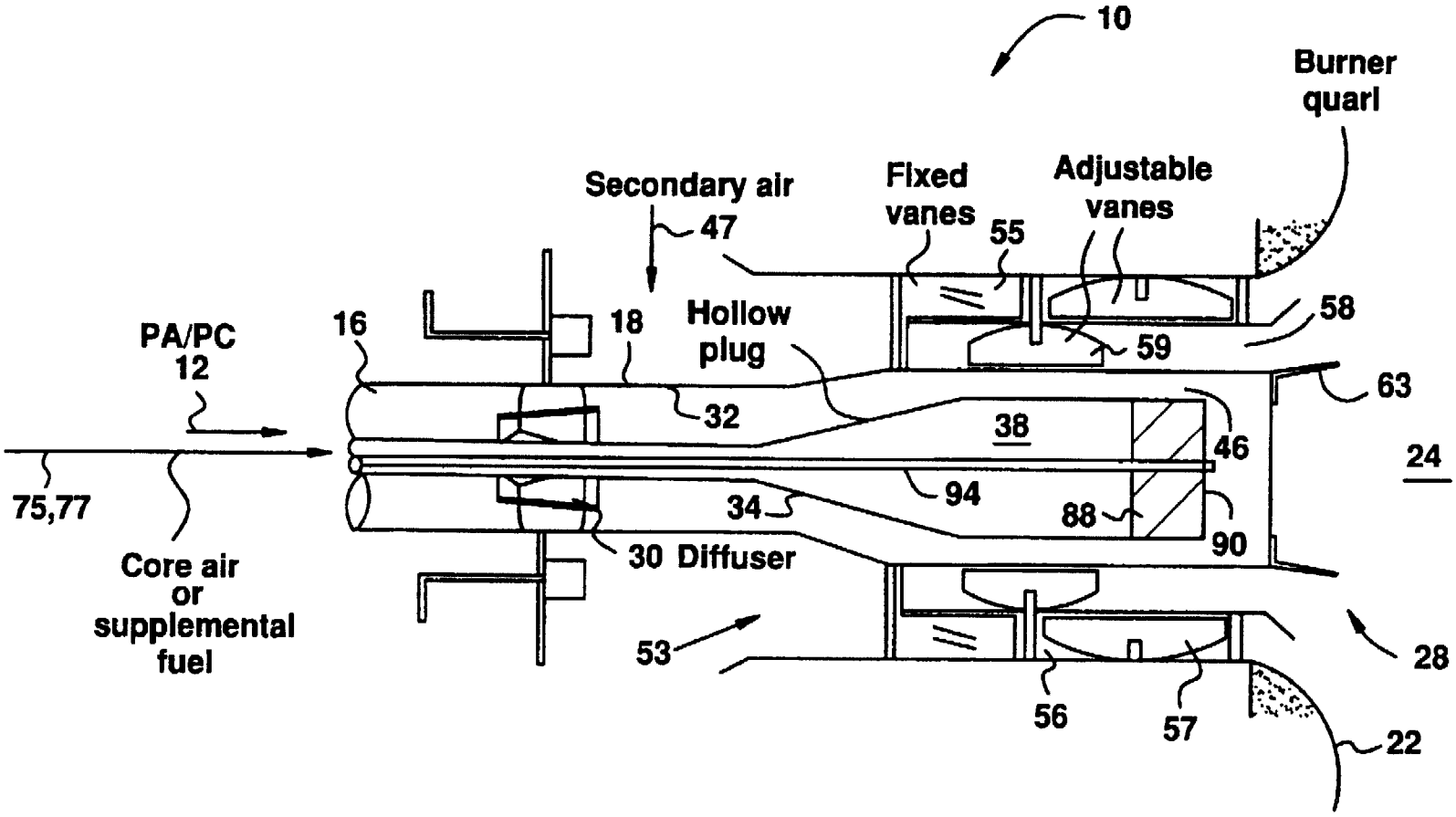
FIG. 4 is a schematic sectional view of a fourth embodiment of a pulverized coal burner according to the present invention, also using a 45° swirler at the outlet of the hollow plug and an extended flame stabilizer ring, but without an air separation vane as illustrated in the previous embodiments.

Referring now to FIG. 4 there is shown a schematic sectional view of a fourth embodiment of a pulverized coal burner 10 according to the present invention, also using a 45° swirler 88 at the outlet 90 of the hollow plug 38 and an extended flame stabilizer ring 63, but without an air separation vane 61 as illustrated in the previous embodiments.

Finally, FIGS. 5–7 illustrate particular constructional details of the 45° swirler 88 mentioned earlier. As shown, the 45° swirler 88 comprises an outer circumferential ring 100 having a plurality of blades 102 located therein connected at their center most portions to a hub 104. As illustrated in FIG. 6, the 45° swirler gets its designation by virtue of the angle of the blades 102. Each of the blades 102 is substantially planar in design, and, as shown in FIG. 7, has an inner radius R1 designed to match the radius of the hub 104, and an outer radius R2 designed to match the radius of the outer circumferential ring 100.

The performance of the burner 10 according to the present invention was proven by small scale combustion tests. These tests were conducted at a firing rate of five million Btu/hr in the Small Boiler Simulator (SBS) at The Babcock & Wilcox Company's Alliance Research Center. The tests showed $NO_x$ emissions lower than the marketed B&W DRB-XCL® burner. The excellent $NO_x$ reduction performance of the DRB-XCL® burner is well established through extensive experience in commercial boilers. In a side-by-side comparison at a burner input of 5 million Btu/hr, the hollow plug burner 10 of the present invention further reduced $NO_x$ by up to 25% relative to the DRB-XCL® burner. Unburned carbon in the flyash was similar for the subject burner relative to the DRB-XCL® burner. That is, further $NO_x$ reduction was achieved without a decrease in combustion efficiency. These tests illustrated that flame length was simultaneously much shorter than with the DRB-XCL® burner. In summary, the best results were achieved by addition of the proper quantity of core air, in this case 4%, with the hollow plug 38 properly positioned (generally retracted approximately 3"). Mixing devices in the hollow plug 38 and at the end of the burner 10 further improve $NO_x$ emission performance.

The above-mentioned test program involved testing of one high volatile bituminous coal, over a narrow range of PA/PC ratios. Coals with higher volatile matter content (Proximate Analysis) would be expected to benefit from introduction of higher quantities of air through the hollow plug 38, for the PA/PC ratios tested, and vice versa for lower volatile coals, as described earlier. Air to the hollow plug 38 would also be varied to compensate for different PA/PC ratios; e.g., a higher air flow would be provided if the actual PA/PC ratio was lower.

Certain modifications and additions have been deleted herein for the sake of conciseness and readability but are properly within the scope of the present invention and will be readily appreciated by those of ordinary skill in this art.

By way of example, the source of introducing air to the hollow plug 38 can be varied to accommodate different burner designs and situations. For testing it was convenient to use compressed air, at low pressure and with preheat. For most commercial applications, however, a larger conduit could be used to reduce pressure drop and permit use of preheated secondary air. Booster fans could also be used to increase pressure when necessary. Alternatively, for units with cold primary air fans, hot primary air can be used. In addition, the method of introducing air to the hollow plug 38 can be varied. For the test program, the air was introduced through the back end of the hollow plug 38, near the burner elbow 12. In some situations it could be beneficial to introduce the air through the conical or cylindrical sides of the hollow plug 38. Further, the diameters of the hollow plug 38 and burner nozzle 16 can be varied, to affect the exit velocities and bluff body effects of the hollow plug 38. Additionally the mixing device at the exit of the hollow plug 38 can be varied. Relatively low $NO_x$ was achieved even without a mixing device. Swirlers increase the mixing rate of the core air with the PA/PC mixture, and reduce axial momentum of the core air which enables short flames. Other types of mixers could be substituted for the 45° swirler, such as tabs or deflectors, cones at the burner nozzle exit to shield the fuel jet, and tabs or vanes to increase turbulence. For the unusual case of a system with a very high PA/PC ratio, the air to coal ratio may already exceed an optimum value. In such a case, flue gas could be introduced into the hollow plug 38 to reduce the partial pressure of oxidant to fuel. Accordingly, it is intended that all such above-mentioned additions or modifications are encompassed in the following claims.

We claim:

1. A low $NO_x$ short flame burner for the combustion of a pulverized coal plus air mixture, comprising:

a nozzle pipe having an inlet for receiving a pulverized coal plus primary air mixture and an outlet for discharging same;

a hollow plug extending axially in the nozzle pipe and defining an annular space between the hollow plug and the nozzle pipe for conveying the pulverized coal plus primary air mixture therethrough; and means for supplying an amount of core air into the hollow plug to maintain a desired primary air to pulverized coal ratio at an outlet of the burner to minimize $NO_x$ production, the amount of core air supplied based upon (1) the coal flow rate being provided to the burner, in lb/hr, and the percent volatile matter content in the coal being burned, and lying within a range defined approximately by the following upper and Lower core air flow rates;

upper core air flow rate (lb/hr)=1.5×coal flow rate (lb/hr) ×(percent volatile matter content/100)

lower core air flow rate (lb/hr)=0.9×coal flow rate (lb/hr) ×(percent volatile matter content/100).

2. The burner according to claim 1, wherein the means for supplying an amount of core air supplies an optimum amount of core air flow to the burner, the amount given by the following relationship: optimum core air flow rate (lb/hr)=1.2×coal flow rate (lb/hr) (percent volatile matter content/100).

3. The burner according to claim 1, comprising a burner barrel positioned around the nozzle pipe and defining at least one annular secondary air passage around the nozzle pipe.

4. The burner as set forth in claim 1, comprising a perforated plate located within the hollow plug through which the core air passes as it is conveyed through the hollow plug.

5. The burner as set forth in claim 1, comprising a 45° swirler at an outlet of the hollow plug.

6. The burner as set forth in claim 1, comprising means for controlling the amount of core air supplied to the hollow plug as a function of the coal flow rate being provided to the burner, in lb/hr, and the percent volatile matter content in the coal being burned.

7. The burner as set forth in claim 6, wherein the core air is provided from a source of secondary air provided to the burner.

8. The burner as set forth in claim 1, comprising means for supplying supplementary natural gas fuel into the hollow plug to permit it to be cofired at the outlet end of the burner with the primary air plus primary coal mixture to further reduce $NO_x$ emissions and unburned combustibles.

9. A method of operating a pulverized coal burner to control a primary air to pulverized coal ratio and minimize $NO_x$ production from the burner, the burner including a nozzle pipe having an inlet for receiving a pulverized coal plus primary air mixture and an outlet for discharging same, a hollow plug extending axially in the nozzle pipe and defining an annular space between the hollow plug and the nozzle for conveying the pulverized coal plus primary air mixture therethrough, and a burner barrel positioned around the nozzle pipe defining at least one annular secondary air passage around the nozzle pipe, comprising the steps of:

determining a coal flow rate being provided to the burner, in lb/hr;

determining a percent volatile matter content in the coal being burned; and supplying core air to the inside of the hollow plug so that it is mixed with the pulverized coal plus primary air mixture at an outlet end of the burner to establish a desired primary air to pulverized coal ratio for combustion to minimize $NO_x$ production from the burner, the amount of core air supplied lying within a range defined approximately by the following Upper and Lower core air flow rates:

upper core air flow rate (lb/hr)=1.5×coal flow rate (lb/hr) ×(percent volatile matter content/100)

lower core air flow rate (lb/hr)=0.9×coal flow rate (lb/hr) ×(percent volatile matter content/100).

10. The method of operating a pulverized coal burner according to claim 9, comprising the step of supplying an optimum amount of core air flow to the burner, the amount given by the following relationship: optimum core air flow rate (lb/hr)=1.2×coal flow rate (lb/hr)×(percent volatile matter content/100).

11. The method of operating a pulverized coal burner according to claim 9, comprising the step of supplying supplementary natural gas fuel into the hollow plug to permit it to be cofired at the outlet end of the burner with the primary air plus primary coal mixture to further reduce $NO_x$ emissions and unburned combustibles.

* * * * *

UNITED STATES PATENT AND TRADEMARK OFFICE

CERTIFICATE OF CORRECTION

PATENT NO. : 5,697,306
DATED : December 16, 1997
INVENTOR(S) : LaRue et al.

It is certified that error appears in the above-identified patent and that said Letters Patent is hereby corrected as shown below:

Column 9,
Line 61, -- x -- should be inserted between "(lb/hr)" and "percent volatile matter content/100)".

Signed and Sealed this

Seventh Day of May, 2002

*Attest:*

*Attesting Officer*

JAMES E. ROGAN
*Director of the United States Patent and Trademark Office*